US009026017B2

(12) United States Patent
Sakamoto

(10) Patent No.: US 9,026,017 B2
(45) Date of Patent: May 5, 2015

(54) IMAGE FORMING APPARATUS INCLUDING A PATCH FORMING UNIT

(75) Inventor: Junshin Sakamoto, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 358 days.

(21) Appl. No.: 13/524,480

(22) Filed: Jun. 15, 2012

(65) Prior Publication Data

US 2012/0321356 A1 Dec. 20, 2012

(30) Foreign Application Priority Data

Jun. 17, 2011 (JP) ..... 2011-134808
May 10, 2012 (JP) ..... 2012-108711

(51) Int. Cl.
*G03G 15/01* (2006.01)
*G03G 15/16* (2006.01)
*G03G 15/00* (2006.01)

(52) U.S. Cl.
CPC ..... *G03G 15/0131* (2013.01); *G03G 15/1605* (2013.01); *G03G 15/5058* (2013.01); *G03G 2215/0161* (2013.01)

(58) Field of Classification Search
CPC ..... G03G 15/0131; G03G 15/5058; G03G 15/1605; G03G 2215/0161
USPC ..... 399/301
See application file for complete search history.

(56) References Cited

U.S. PATENT DOCUMENTS

2005/0147424 A1* 7/2005 Kato et al. ..... 399/49
2005/0195235 A1* 9/2005 Kitao ..... 347/19
2011/0222885 A1* 9/2011 Yamaki et al. ..... 399/66

FOREIGN PATENT DOCUMENTS

JP 2003-280317 10/2003
JP 3558620 5/2004
JP 2011-2616 1/2011
JP 2011-64825 3/2011
JP 2011-170314 9/2011

* cited by examiner

*Primary Examiner* — Billy Lactaoen
(74) *Attorney, Agent, or Firm* — Oblon, McClelland, Maier & Neustadt, L.L.P.

(57) ABSTRACT

An image forming apparatus includes a patch forming unit configured to form a patch group containing patch subgroups arranged in a sub-scanning direction. Each of the patch subgroups contains a reference color patch and a color patch of a different color. The reference color patches are shifted from each other in a main-scanning direction. The color patches are shifted from each other in the main-scanning direction. The patch subgroups include reference patch subgroups in each of which the reference color patch covers over the color patch and detection patch subgroups in each of which at least part of the color patch does not overlap with the reference color patch. Center positions of non-overlapping portions of the color patches that do not overlap with the reference color patches in the main-scanning direction are located at substantially a same position in the patch group.

15 Claims, 14 Drawing Sheets

IMAGE FORMING APPARATUS INCLUDING A PATCH FORMING UNIT

CROSS-REFERENCE TO RELATED APPLICATIONS

The present application claims priority to and incorporates by reference the entire contents of Japanese Patent Application No. 2011-134808 filed in Japan on Jun. 17, 2011 and Japanese Patent Application No. 2012-108711 filed in Japan on May 10, 2012.

BACKGROUND OF THE INVENTION

1. Field of the Invention

The present invention relates to an image forming apparatus.

2. Description of the Related Art

Conventionally, various types of inkjet printers or laser printers have been provided as image forming apparatuses. For example, an inkjet printer includes one inkjet head for each of black (K), magenta (M), cyan (C) and yellow (Y) to be recorded, i.e., a total of four inkjet heads, each of which can perform linear recording of a sheet width and which are disposed along a moving direction (sub-scanning direction y) of a recording-sheet conveying belt. The inkjet printer forms an image by causing a plurality of units to form toner images of the respective colors and recording the toner images on a sheet of paper on the conveying belt in an overlapping manner.

As the laser printers, for example, a tandem system and a single photoreceptor system are known. A laser printer of the tandem system includes one image forming unit for each of black (K), magenta (M), cyan (C), and yellow (Y) to be recorded, i.e., a total of four image forming units, each of which mainly includes a photoreceptor and a developing unit and which are disposed along a moving direction (hereinafter, the sub-scanning direction y) of a recording-sheet conveying belt or an intermediate transfer belt. The laser printer of the tandem system forms an image by causing the image forming units to form toner images of the respective colors on the photoreceptors and transfer the toner images onto a sheet of paper or the intermediate transfer belt in a superimposed manner. A laser printer of the single photoreceptor system forms an image by repeating, as many times as the number of colors to be used, a process of forming a toner image of one color on a single photoreceptor, transferring the toner image onto a sheet of paper or an intermediate transfer medium, forming another toner image of a different color on the photoreceptor, and transferring the toner image onto the previously-transferred toner image in a superimposed manner.

However, in the image forming apparatuses of both systems, toner images of different colors or different inks are recorded on the same sheet of paper in a superimposed or overlapping manner. Therefore, color deviation or color shade variation may easily occur due to relative positional deviation of the images of the different colors.

In a color image forming apparatus of the tandem system, relative positional deviation of superimposed toner images causes color deviation or color shade variation, resulting in reduced image quality. Therefore, conventionally, to adjust positions (registration) of latent images, registration deviation is detected by using an image recorded on a transfer belt and write timing at positions in the main-/sub-scanning directions is changed to perform adjustment (registration correction).

For example, Japanese Patent Laid-open Publication No. 2003-280317 discloses a positional deviation correction method for correcting deviation of transfer positions. In this method, a pattern is formed as a patch, in which a reference pattern containing a plurality of lines that are formed with black toner serving as a reference color and that are arranged at a predetermined pitch are superimposed on a correction-target color pattern containing a plurality of lines that are formed with color toner and that are arranged at the same pitch as that of the reference patterns. A patch group is formed by sequentially forming a plurality of the patches in a read direction of a detection sensor such that relative positions of the lines are shifted by an arbitrary amount in a pitch direction of the lines. In this method, it is assumed that the black toner serving as the reference color is lastly superimposed onto a transfer medium, and a pattern in which the correction-target color patterns are completely superimposed on or separate from the reference patterns is used as a reference patch. Based on this assumption, patch groups are formed by sequentially arranging a plurality of the patches on the front and rear sides of the reference patch in the read direction of the detection sensor. An intersection of two straight lines is calculated, where the straight lines indicate outputs on both sides of an inflection point of optically-detected values of the patches according to arbitrary shift amounts of the patch groups that are sequentially arranged in a correction pattern in a correction-pattern forming direction. Subsequently, an amount of deviation of the transfer positions on the transfer belt at which toner is transferred from photosensitive drums is calculated based on the intersection, and exposing timing of each of the photosensitive drums is corrected based on the amount of deviation.

If the positional deviation correction method disclosed in Japanese Patent Laid-open Publication No. 2003-280317 is performed before start of printing, it is possible to obtain an image with less positional deviation.

If continuous printing is performed, the temperature of the whole image forming apparatus increases and thermal expansion of units of the image forming apparatus occurs; therefore, positional deviation gradually occurs with respect to a value that has been corrected before printing, resulting in color deviation of an image. However, in the method disclosed in Japanese Patent Laid-open Publication No. 2003-280317, printing is suspended to form patches according to a change in the temperature or according to the amount of printing, a correction amount of positional deviation is calculated by reading an interval between the patches, and the positional deviation of colors in the main-/sub-scanning directions are corrected again.

In Japanese Patent Laid-open Publication No. 2003-280317, it is disclosed that the relationship among the length of each of the patches, the interval between the patches, and a spot diameter formed on the transfer medium by a detection sensor is "(the length of each of the patches)+(the interval between the patches)>(twice the size of the spot diameter on the transfer medium)". However, in actuality, a light emission pattern of spot light from the detection sensor (a light emitting diode (LED)) is, in some cases, non-uniform and horizontally asymmetry.

This will be explained below with reference to FIG. 14. Illustrated in (*a*) of FIG. 14 is a schematic diagram of a part of the patch disclosed in Japanese Patent Laid-open Publication No. 2003-280317. Illustrated in (*b*) of FIG. 14 is a graph (the horizontal axis represents a distance) of a light emission pattern of light applied to the transfer belt. Illustrated in (*c*) of FIG. 14 is a graph in which peak values of the detected diffused output voltages are plotted.

When a horizontally-symmetric light emission pattern indicated by a bold line A in (*b*) of FIG. 14 is obtained, a color toner portion is shifted in a region where the amount of light is stable. Therefore, the detection sensor can stably receive diffused light from the patches without a variation in the amount of diffused reflected light.

However, as indicated by a dashed line B in (*b*) of FIG. 14, in actuality, the light emission pattern of the detection sensor may be horizontally deformed (asymmetry) due to an attachment error of a light source or an attachment error of an optical system. For example, when a light emission pattern indicated by the dashed line B is obtained, and if color toner is gradually shifted to the left on a patch-by-patch basis, the position of receiving light from the detection sensor is gradually shifted to the left and the amount of light received from the detection sensor is reduced.

As illustrated in (*c*) of FIG. 14, in the case of the dashed line B, the amount of light applied from the detection sensor for the first patch (the leftmost plot in (*c*) of FIG. 14) is obtained at the flat position. However, because the amount of light on the left side is reduced as the color patch is shifted to the left, the diffused light is gradually reduced relative to the bold line A.

However, in Japanese Patent Laid-open Publication No. 2003-280317, the value of the detection sensor is detected on the assumption that the amount of applied light does not change, and the amount of positional deviation is calculated based on the detected value. Therefore, for example, in the case of the dashed line B, the amount of applied light changes along with the shift of the color toner, and the intersection of two straight lines indicating outputs on the both sides of the inflection point described above becomes an intersection indicated on the dashed line B in (*c*) of FIG. 14 resulting in an error. Therefore, in some cases, a result different from actual positional deviation is calculated. If a wrong correction amount is calculated, positional deviation cannot accurately be corrected, and in some cases, color deviation gets even worse after correction of the positional deviation.

Therefore, there is a need for an image forming apparatus capable of obtaining a print image of good quality with less color deviation or color shade variation.

SUMMARY OF THE INVENTION

It is an object of the present invention to at least partially solve the problems in the conventional technology.

According to an embodiment, there is provided an image forming apparatus that includes a patch forming unit configured to form a patch group containing a plurality of patch subgroups arranged in a sub-scanning direction, each of the patch subgroups containing a reference color patch formed with toner of a reference color and a color patch formed with toner of a different color such that the reference color patch and the color patch are arranged in a main-scanning direction. The reference color patches are shifted from each other in the main-scanning direction, the color patches are shifted from each other in the main-scanning direction, and the patch subgroups include reference patch subgroups in each of which the reference color patch covers over the color patch and detection patch subgroups in each of which at least part of the color patch does not overlap with the reference color patch. The image forming apparatus also includes a positional deviation correcting unit configured to calculate a correction amount based on a detection result of the reference patch subgroups and the detection patch subgroups detected by a detecting unit. The patch forming unit forms the detection patch subgroups so that center positions of non-overlapping portions of the color patches that do not overlap with the reference color patches in the main-scanning direction are located at substantially a same position in the patch group.

According to another embodiment, there is provided an image forming apparatus that includes a patch forming unit configured to form a patch group containing patches in sequence in a sub-scanning direction so that the patches are shifted from each other in a main-scanning direction; a detecting unit configured to detect reflected light from each of the patches contained in the patch group; and a positional deviation correcting unit configured to calculate a correction amount based on the reflected light detected by the detecting unit. The patch forming unit forms the patch group so that a position at which a variation in an amount of the reflected light is small is located in a center of a range of the patches contained in the patch group in the main-scanning direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained in detail below based on configurations illustrated in FIG. 1 to FIG. 13.

Configuration of Image Forming Apparatus

Figure 1:
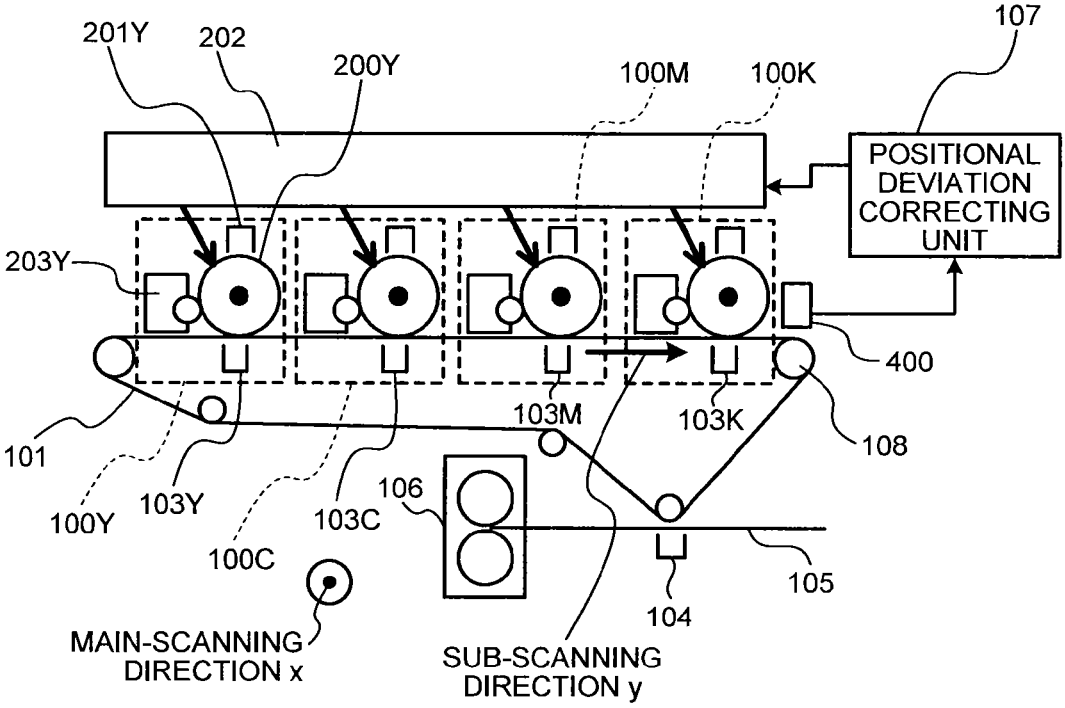
FIG. 1 is a schematic configuration diagram of an image forming apparatus according to an embodiment of the present invention.

FIG. 1 is a schematic configuration diagram of an image forming apparatus according to an embodiment of the present invention. The image forming apparatus uses a Carlson process of a tandem system.

The image forming apparatus illustrated in FIG. 1 is a color laser printer of the tandem system and includes image forming units 100K, 100M, 100C, and 100Y for forming images with color materials (toner) of black (K), magenta (M), cyan (C), and yellow (Y). The image forming units 100K to 100Y are disposed along an intermediate transfer belt 101 serving as an intermediate transfer means.

Each of the image forming units 100 (100K to 100Y) includes a photoreceptor 200 (200K to 200Y), a charging unit 201 (201K to 201Y), a developing unit 203 (203K to 203Y), and a cleaning unit (not illustrated). In FIG. 1, only the photoreceptor 200Y, the charging unit 201Y, and the developing unit 203Y of the image forming unit 100Y are denoted by reference codes; however, the other image forming units 100K, 100M, and 100C are configured in the same manner as illustrated in FIG. 1.

A multibeam optical scanning device 202 converts a signal sent as color image data for each of the colors into a write signal and outputs image light (laser beam) for recording each of the colors to the corresponding photoreceptor 200. Each of the image forming units 100 forms a color toner image on the corresponding photoreceptor 200 through a series of Carlson processes (electrophotographic processes). Each of the image forming units 100 also functions as a patch forming unit for forming a toner image pattern (also described as a patch pattern image or a patch) for detecting positional deviation to be described later.

The toner images formed by the image forming units 100 are transferred onto the same position on the intermediate transfer belt 101 in a superimposed manner by primary transfer chargers (may be transfer rollers) 103 (103K to 103Y) serving as a primary transfer means. The color toner images transferred on the intermediate transfer belt 101 are collectively transferred onto a sheet of paper (a recording medium) 105 by a secondary transfer charger (may be a transfer roller) 104 serving as a secondary transfer means.

The color toner image transferred on the sheet 105 is fixed on the sheet 105 by a fixing unit 106 to complete image formation. The intermediate transfer belt 101 is extended around a plurality of rollers including a driving roller 108 and is driven to rotate by a driving unit (not illustrated) to move from left to right in FIG. 1 just below the photoreceptors 200. This moving direction is assumed as a sub-scanning direction (y) and a width direction of the sheet 105 orthogonal to the sub-scanning direction (y) is assumed as a main-scanning direction (x).

A positional deviation correcting unit 107 includes a process controller that controls an image forming engine (hardware and processes) including the image forming units 100, the optical scanning device 202, and the intermediate transfer belt 101; and an interface controller that inputs and outputs a control signal and a detection signal with respect to the hardware. Each of the controllers is made up of an information processing apparatus that mainly includes a central processing unit (CPU) or a microprocessing unit (MPU).

Toner Image Pattern for Detecting Positional Deviation

A toner image pattern (a patch) generated by a patch forming unit to detect positional deviation will be explained below.

The patch forming unit forms a toner image pattern on the intermediate transfer belt 101 before an image forming operation is performed on the sheet 105. For example, the toner image pattern is formed when the image forming apparatus is activated (just after a main power switch is turned on to switch the main power on), or when the image forming apparatus is resumed (just after an energy-saving mode for saving energy is switched to a standby mode for enabling printing operations). The operations of forming the toner image pattern and calculating a correction amount based on the toner image pattern are performed as a series of operations.

It is preferable to perform the series of operations when a temperature detecting unit (included in the image forming apparatus) detects that a temperature has changed by a predetermined amount or greater, when a timer (included in the image forming apparatus) detects that a predetermined time has elapsed, or when a counter (included in the image forming apparatus) detects that a predetermined number of sheets have been printed.

Detection of Toner Image Pattern by Diffused Light

Figure 2:
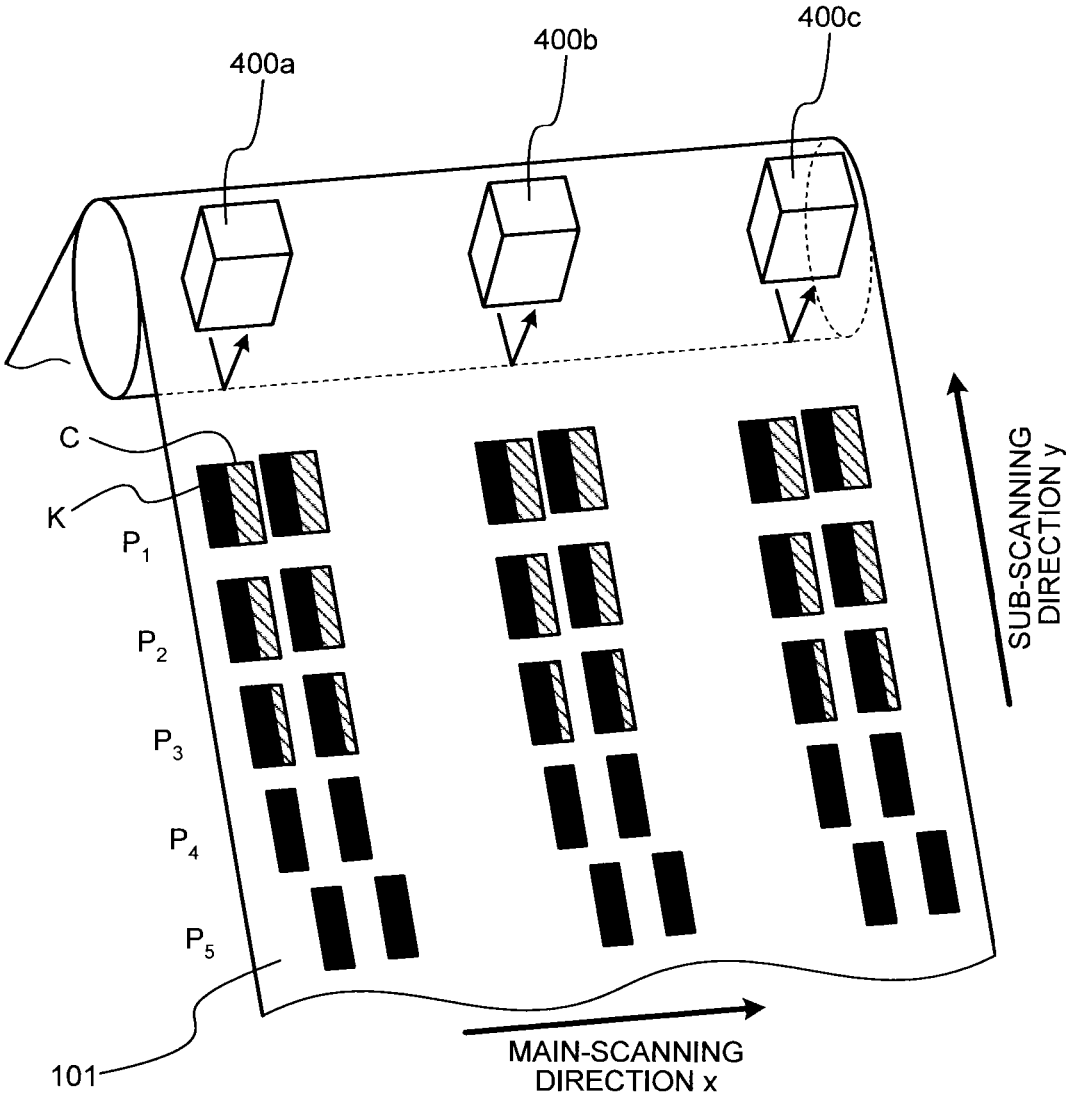
FIG. 2 is a perspective view of distributed patches as a part of toner image patterns formed on an intermediate transfer belt.

FIG. 2 illustrates a part of toner image patterns that are formed (transferred) by each of the image forming units 100 in accordance with diffused light for detecting positional deviation. As illustrated in FIG. 2, toner image patterns $P_n$ ($P_1$, $P_2$, $P_3$ . . . ) transferred on the intermediate transfer belt 101 by each of the image forming units 100 are conveyed in the sub-scanning direction along with rotational movement of the intermediate transfer belt 101, and are detected by image position detectors 400 (400*a* to 400*c*) serving as a detecting unit.

Figure 3:
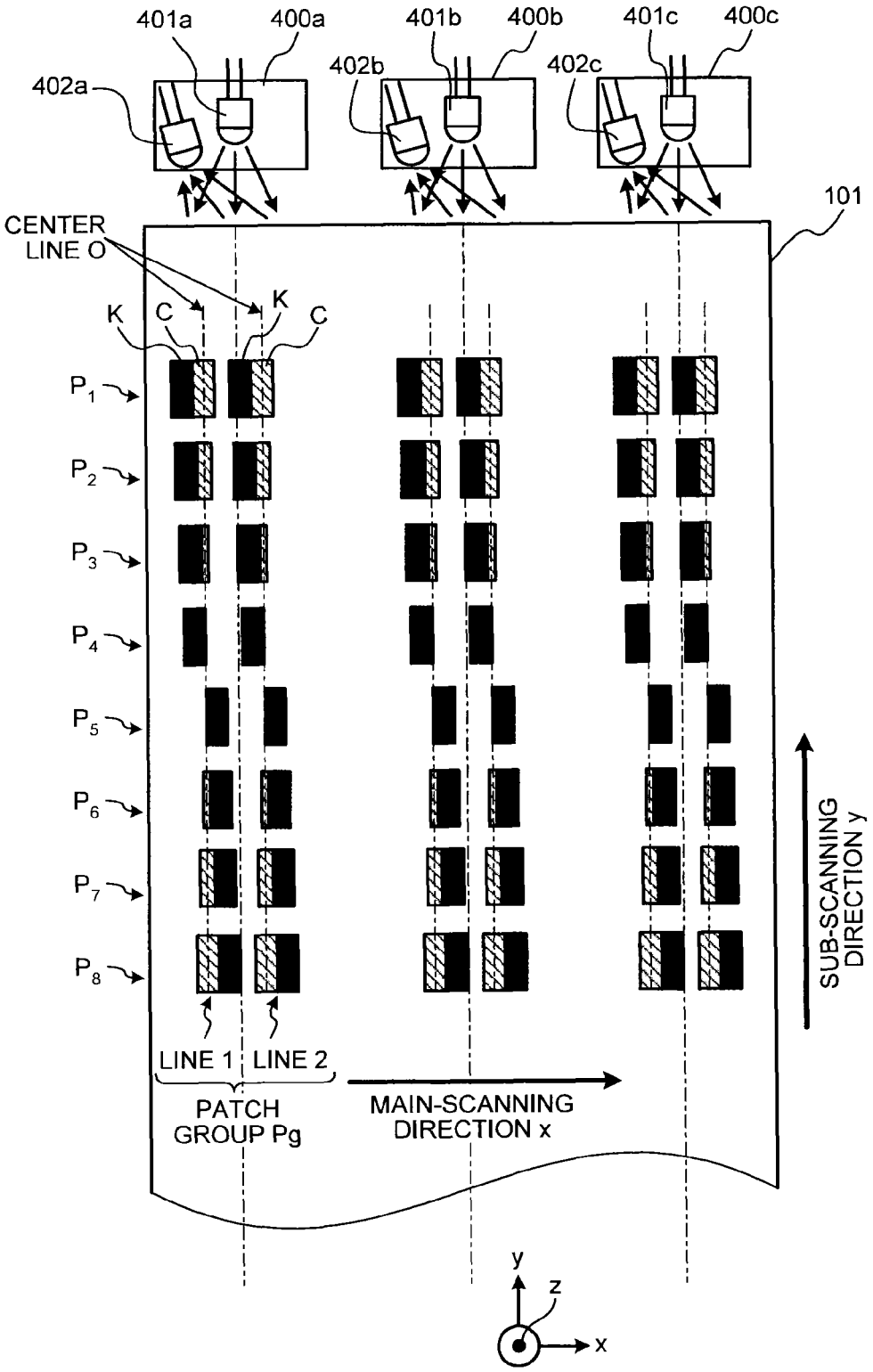
FIG. 3 is a plan view of the distributed patches as the toner image patterns formed on the intermediate transfer belt.

FIG. 3 illustrates the whole toner image patterns for detecting positional deviation, which are formed (transferred) by each of the image forming units 100. In the following, the toner image patterns $P_n$ formed by each of the image forming units 100 and a positional deviation correction process will be explained with reference to FIG. 3.

Each of the toner image patterns $P_n$ (n=1 . . . m, each of patches $P_1$ to $P_8$) is formed as a pattern, in which a reference color patch K containing a plurality of lines that are formed with predetermined widths with use of toner of a reference color and that are arranged at a predetermined pitch (a line space) are superimposed on a color patch C containing a plurality of lines that are formed with use of toner of a different color (C, M, or Y) being a correction target color and that are arranged at the same pitch as the reference color patches K. The width of each of the toner image patterns $P_n$ in the sub-scanning direction is also set to a predetermined length.

In the present embodiment, the number of lines is set to two (lines 1 and 2); however, the number of lines is not limited to this example. For example, the number of lines may be one or may be three or greater. A spot diameter formed on the intermediate transfer belt 101 by a light-emitting element 401 of each of the image position detectors 400 is equal to or greater than the size of each of the toner image patterns $P_n$ in the main-scanning direction. The same is applied when a plurality of lines are formed.

In the present embodiment, the black patches K are formed by assuming that the reference color is black which is the same color as the intermediate transfer belt (which is a color lastly superimposed onto a medium). However, the reference color is not limited to black. The intermediate transfer belt 101 is formed as, for example, a black polyimide belt.

Hereinafter, the toner image patterns $P_n$ that are sequentially formed in a plurality of lines in the sub-scanning direction are collectively described as one patch group Pg (a positional deviation correction pattern). It is preferable to form a plurality of the patch groups Pg in a plurality of rows in the main-scanning direction. In the present embodiment, the patch groups Pg are formed in three rows in the main-scanning direction (patch groups 1 to 3). The number of the patch groups Pg to be formed is not limited to this example. It is sufficient to provide the image position detector 400 for each patch group Pg. It is preferable to form each of the patch groups Pg within a print area on the intermediate transfer belt 101.

The patch forming unit of the image forming apparatus of the present embodiment forms the patch group Pg such that the reference color patches K and the color patches C satisfy the following relative positional relation.

Specifically, the patch forming unit sequentially forms the toner image patterns $P_n$ at predetermined intervals in the sub-scanning direction such that the reference color patches K and the color patches C are shifted by an arbitrary amount in the main-scanning direction (in a pitch direction). At this time, the patch forming unit forms the patch group Pg such that the center positions of non-overlapping portions of the color patches C that do not overlap with the reference color patches K are located at approximately the same positions in the main-scanning direction after the reference color patches K and the color patches C overlap. In other words, if a certain line (a center line O in FIG. 3) is assumed to be present, the patch group Pg is formed by sequentially forming a plurality of the reference color patches K and the color patches C in the sub-scanning direction such that the center positions of the color patches C in the main-scanning direction are approximately on the line. "Approximately on the line" means that, for example, an error of the center positions is within a predetermined threshold.

Figure 14:
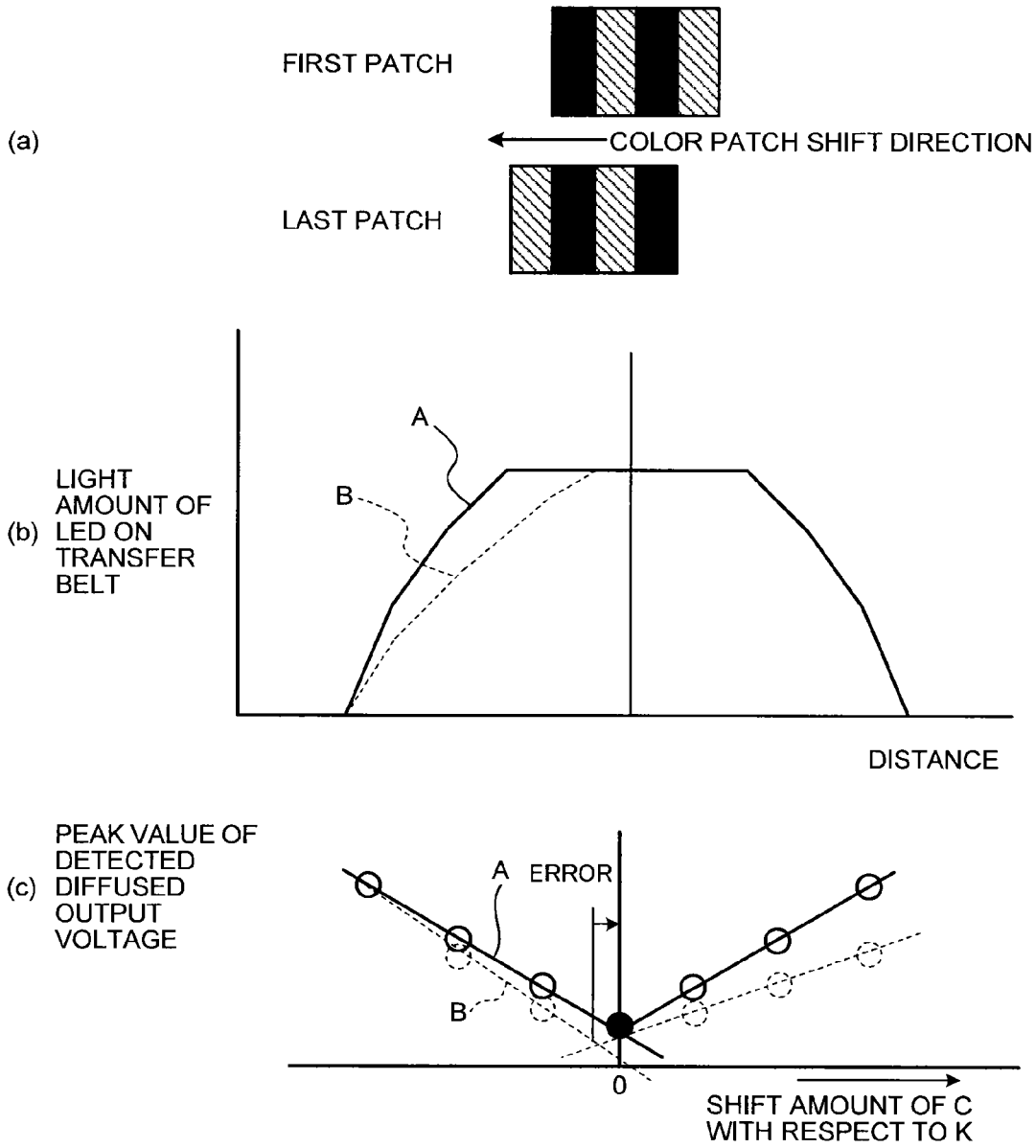
FIG. 14 illustrates a schematic diagram of a part of patches disclosed in known systems in (*a*), a graph of a light emission pattern of light applied to a transfer belt from a sensor in (*b*), and a graph in which peak values of diffused output voltages are plotted in (*c*).

If the toner image patterns $P_n$ of the patch group Pg are formed such that the toner image patterns $P_n$ are shifted as described above, it is possible to significantly reduce a variation in the amount of light received by the color patches C. Therefore, it becomes possible to reduce the influence of non-uniformity between left and right light emission patterns caused by an attachment error of the light-emitting element 401 of each of the image position detectors 400 or an attachment error of an optical system as illustrated by the dashed line B in (*b*) of FIG. 14 as mentioned earlier. Consequently, it becomes possible to prevent occurrence of color deviation due to a variation in the amount of applied light.

As described above, according to the image forming apparatus of the present embodiment, the patch forming unit can form patches so as to prevent positional deviation due to a detection error of a detecting unit caused by a non-uniform light emission pattern of the detecting unit. Therefore, it is possible to calculate a correction amount based on the patches and obtain a printed image of good quality with less color deviation or color-shade variation.

Positional Deviation Correction Control Using Diffused Light

Positional deviation correction control using diffused light by the positional deviation correcting unit 107 will be explained below. The correction method is not limited to an example below. Any method that can correct positional deviation by using the patch group Pg as described above can be applied as the correction method.

As illustrated in FIG. 3, the image forming apparatus includes the image position detectors 400 (400*a* to 400*c*). Each of the image position detectors 400 is, for example, a reflective photosensor including the light-emitting element 401 (401*a* to 401*c*) and a light-receiving element 402 (402*a* to 402*c*). Light emitted by the light-emitting element 401 is diffusely reflected by the intermediate transfer belt 101 and received by the light-receiving element 402.

When the toner image patterns $P_n$ are formed in a detection range on the intermediate transfer belt 101, the amount of diffused light received by the light-receiving element 402 changes, so that each of the image position detectors 400 can detect the toner image patterns Pn. Therefore, diffused detection signals of the toner image patterns $P_n$ are obtained as output of each of the image position detectors 400.

The positional deviation correcting unit 107 measures the diffused detection signals of the color patch C portions when the reference color patches K overlap with the color patches C, and calculates the amount of positional deviation between the reference color patches K and the color patches C based on diffused output voltages of the diffused detection signals. Furthermore, light-emitting timing at which a semiconductor laser of the optical scanning device 202 of each of the image forming units 100 emits a laser beam is controlled based on the amount of positional deviation. Therefore, it is possible to reduce the amount of positional deviation, enabling to reduce relative positional deviation between colors and obtain an image without color deviation.

It is also possible to calculate a difference in magnification between colors (horizontal magnification or overall magnification) in the main-scanning direction based on a result of positional deviation between the patch groups Pg in three rows. Therefore, it is possible to correct the positional deviation by controlling light-emitting timing, a light-emitting clock frequency, or the like.

The correction control will be described in detail below. Toner image patterns $P_n$ in each of which the color patch C is not deviated from the reference color patch K (patch subgroup in which the reference color patches K covers over the color patch C) are assumed as reference patch subgroups ($P_4$ and $P_5$ in FIG. 3). In contrast with the reference patch subgroups ($P_4$ and $P_5$), the other toner image patterns $P_n$ ($P_1$ to $P_3$ and $P_6$ to $P_8$) in the patch group Pg are assumed as deviation amount detection patch subgroups (detection patch subgroups).

An explanation is given of a calculation of positional deviation of the deviation detection patch subgroups with respect to the reference patch subgroups. First, a state without positional deviation will be explained.

Figure 4:
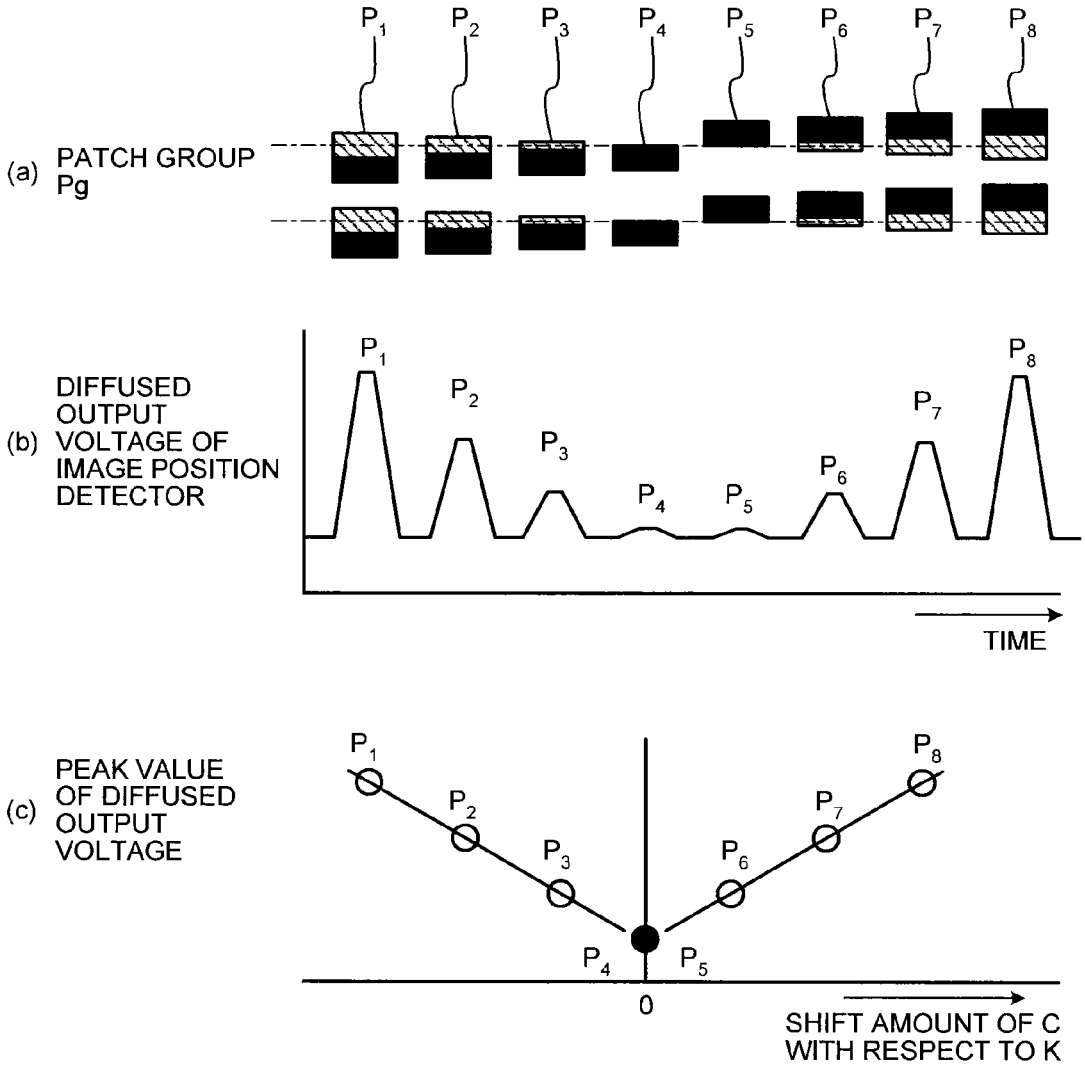
FIG. 4 illustrates a schematic diagram of a patch group without color deviation in (*a*), a graph of a waveform of diffused output voltages obtained when an image position detector detects patches in the patch group without color deviation in (*b*), and a graph in which peak values of the diffused output voltages without color deviation are plotted in (*c*)

Illustrated in (*a*) of FIG. 4 is a schematic diagram of the patch group Pg illustrated in FIG. 3, which is arranged horizontally in order to clarify correspondence to (*b*) and (*c*) of FIG. 4. Illustrated in (*b*) of FIG. 4 is a graph of a waveform of the diffused output voltages (the vertical axis) obtained when the patches $P_n$ in the patch group Pg are detected by the image position detector 400. The horizontal axis of the graph in (*b*) of FIG. 4 represents time. Illustrated in (*c*) of FIG. 4 is a graph in which peak values of the diffused output voltages illustrated in (*b*) of FIG. 4 are plotted. The horizontal axis of the graph in (*c*) of FIG. 4 represents the amount of shift of the color patches C in the deviation amount detection patch subgroups with respect to the reference color patches K.

It can be seen from (*b*) and (*c*) of FIG. 4 that the diffused output voltages of the reference patch subgroups $P_4$ and $P_5$, in which the reference patch subgroups K and the color patches C completely overlap each other, are the smallest; the diffused output voltage becomes greater as the overlapping portion becomes smaller; and the diffused output voltages of detection patch subgroups $P_1$ and $P_8$ without overlapping portions are the greatest.

When there is positional deviation (FIG. 5 as described below), the peak values of the diffused output voltages of the respective patches are plotted as the amounts of shift of the color patches C with respect to the reference color patches K based on the detection result that is obtained without positional deviation (FIG. 4). Furthermore, an intersection of approximate straight lines of the plots of the deviation amount detection patch subgroups ($P_1$ to $P_3$ and $P_6$ to $P_8$) is calculated while excluding the reference patch subgroups ($P_4$ and $P_5$). Therefore, it is possible to calculate the positional deviation.

Figure 5:
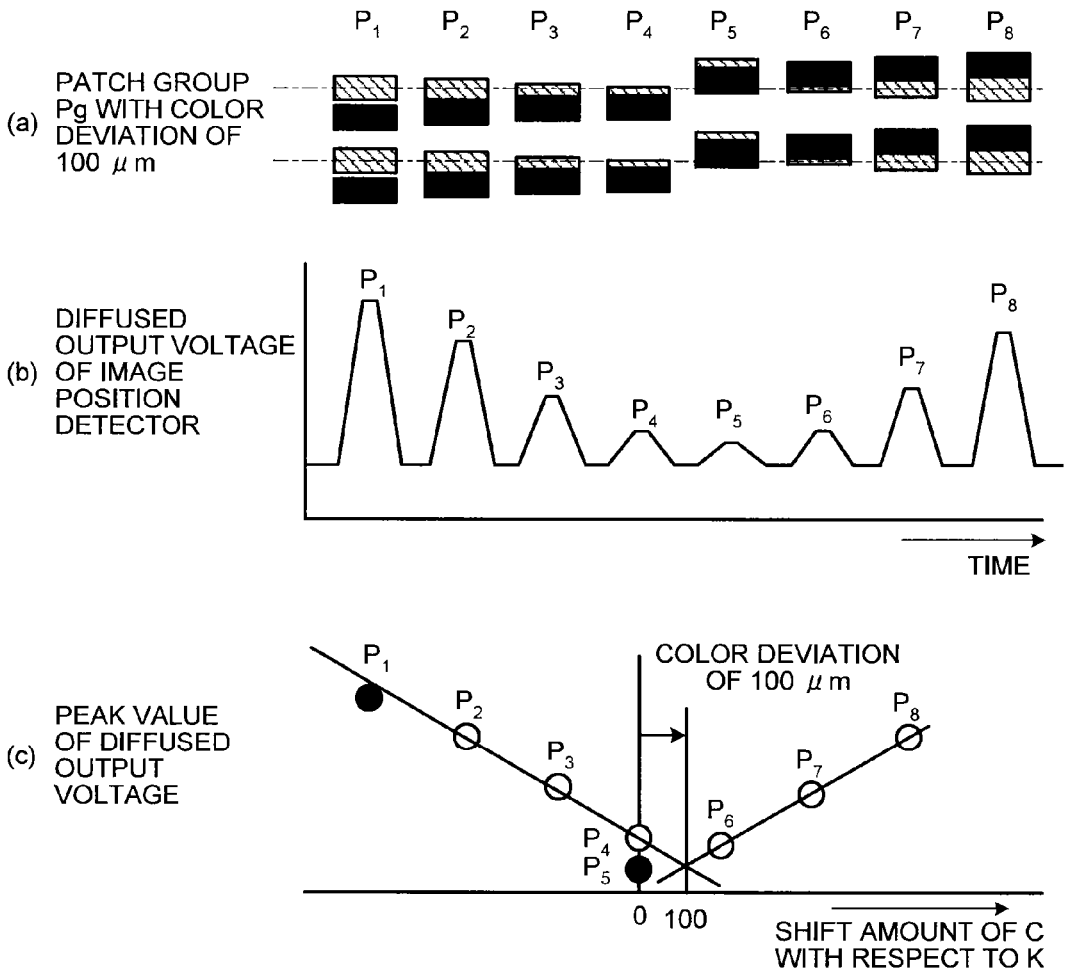
FIG. 5 illustrates a schematic diagram of a patch group with color deviation in (*a*), a graph of a waveform of diffused output voltages obtained when the image position detector detects patches in the patch group with color deviation in (*b*), and a graph in which peak values of the diffused output voltages with color deviation are plotted in (*c*)

Detailed explanation will be given below. For example, an example is explained in which the positional deviation of 100 micrometers occurs in the main-scanning direction. Illustrated in (*a*) of FIG. 5 is a schematic diagram of a patch group Pg with positional deviation, which is arranged horizontally in order to clarify correspondence to (*b*) and (*c*) of FIG. 5. Illustrated in (*b*) of FIG. 5 is a graph of a waveform of the diffused output voltages (vertical axis) obtained when patches $P_n$ in the patch group Pg illustrated in (*a*) of FIG. 5 are detected by the image position detector 400. The horizontal axis of the graph in (*b*) of FIG. 5 represents time. Illustrated in (*c*) of FIG. 5 is a graph in which peak values of the diffused output voltages illustrated in (*b*) of FIG. 5 are plotted. The horizontal axis of the graph in (*c*) of FIG. 5 represents the amount of shift of the color patches C in the deviation amount detection patch subgroups with respect to the reference color patches K.

In contrast with the case where there is no positional deviation (FIG. 4), in the example in FIG. 5, the patch $P_1$ contains the reference color patch K and the color patch C that do not overlap but are separated by a gap of 100 micrometers. In contrast, the patch $P_8$ contains an overlapping portion of 100 micrometers. Even in each of the reference patch subgroups $P_4$ and $P_5$, the reference color patches K do not cover over the color patches C but color patch C portions of 100 micrometers arise as non-overlapping portions. As illustrated in (*b*) of FIG. 5, the peak values of the diffused output voltages of the reference patch subgroups have the relation $P_4>P_5$, and the first and the last deviation amount detection patch subgroups have the relation $P_1>P_8$.

When the above relations are satisfied, as illustrated in (*c*) of FIG. 5, it is possible to calculate the amount of color deviation (100 micrometers) by calculating the intersection of approximate straight lines of the plots of the patches on the both sides while excluding data of the patches $P_1$ and $P_5$. When, for example, the positional deviation occurs in a direction opposite the main-scanning direction, the signs described above are reversed. Therefore, it is possible to calculate the amount of positional deviation by performing linear approximation while excluding data of the patches $P_8$ and $P_4$.

Positional Deviation Correction Control Using Specular Reflected Light

The positional deviation correction control using diffused light has been explained as an example. Even when specular reflected light is used to detect positional deviation, if the center positions of formed patches do not approximately match detection positions in the main-scanning direction, the detection may be performed at edge portions of the patches. In this case, positions may be detected erroneously and a correction amount may be calculated erroneously. To prevent such errors, it is necessary to extend the patches in the main-scanning direction so that the patch widths can be wide enough to be detected assuredly. However, in this case, a more amount of toner than needed is used. In the following, positional deviation correction control using specular reflected light is explained.

Figure 6:
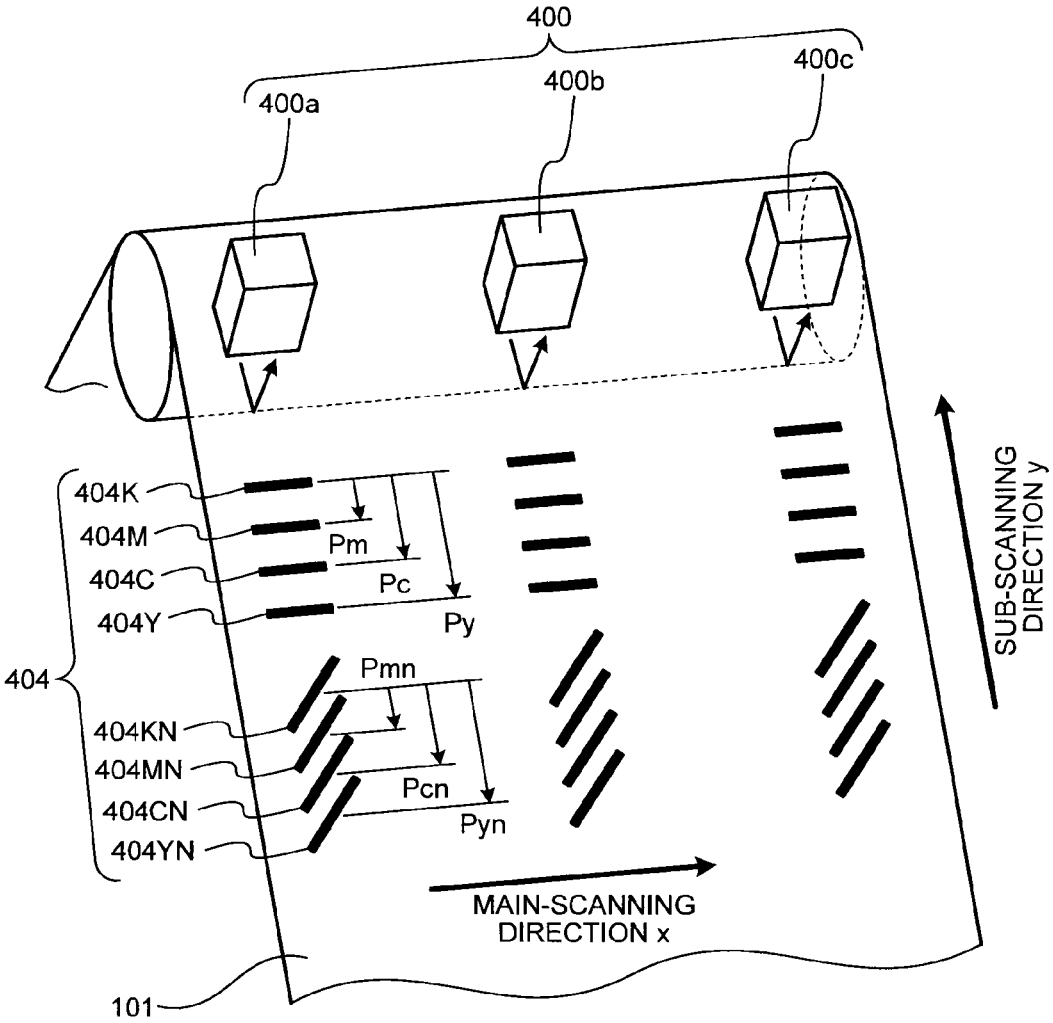
FIG. 6 is an enlarged perspective view of distributed toner image patterns formed on the intermediate transfer belt for detecting specular reflected light.

As illustrated in FIG. 6, color patches 404K, 404M, 404C, 404Y, 404KN, 404MN, 404CN, and 404YN for detecting positional deviation are formed by the image forming units 100K to 100Y and transferred onto different positions on the intermediate transfer belt 101. A patch 404 transferred on the intermediate transfer belt 101 is detected by the image position detector 400 (400*a* to 400*c*). The positional deviation correcting unit 107 illustrated in FIG. 1 measures a time interval (a relative time difference) between a detection signal of a certain color, in this example, the patch 404K for black K, and a detection signal of each of the patches 404Y, 404M, and 404C for the other colors Y, M, and C. The semiconductor laser of the optical scanning device 202 emits light such that the relative time difference becomes a target relative time difference, and the sub-scanning position (the position in the circumferential direction) of the laser beam for exposing the photoreceptor 200 is controlled with respect to the photoreceptor. That is, the image formation positions for the colors M, C, and Y are adjusted so as to be located with a target pitch interval from the image formation position for black K on the intermediate transfer belt 101. As illustrated in FIG. 6, the registration positions in the sub-scanning direction are adjusted based on the horizontal line patches 404K to 404Y. The registration positions in the main-scanning direction are adjusted based on the relative time difference among the horizontal line patches 404K to 404Y and the oblique line patches 404KN to 404YN.

In this example, the patch pattern for one time is illustrated. However, in actuality, a measurement error may occur due to a mechanical speed fluctuating factor. Therefore, similar test patterns are repeatedly formed in the sub-scanning direction, registration adjustment values are calculated in the same manner as described above, and an average of the registration adjustment values is calculated. Consequently, a mechanical cyclic error can be reduced.

The patches 404 on the intermediate transfer belt 101 are formed at three positions in the main-scanning direction x. The toner patches on both ends are formed at both ends of a write region, and the remaining one is formed in the center of the write region. The write region is an area in which a toner image can be transferred onto a sheet. In the registration correction, a skew adjustment value of a scanning line and an adjustment value of a scanning width are determined in addition to the registration adjustment values in the main-scanning direction x and the sub-scanning direction y by using the toner patches formed at three positions in the write region.

Figure 7:
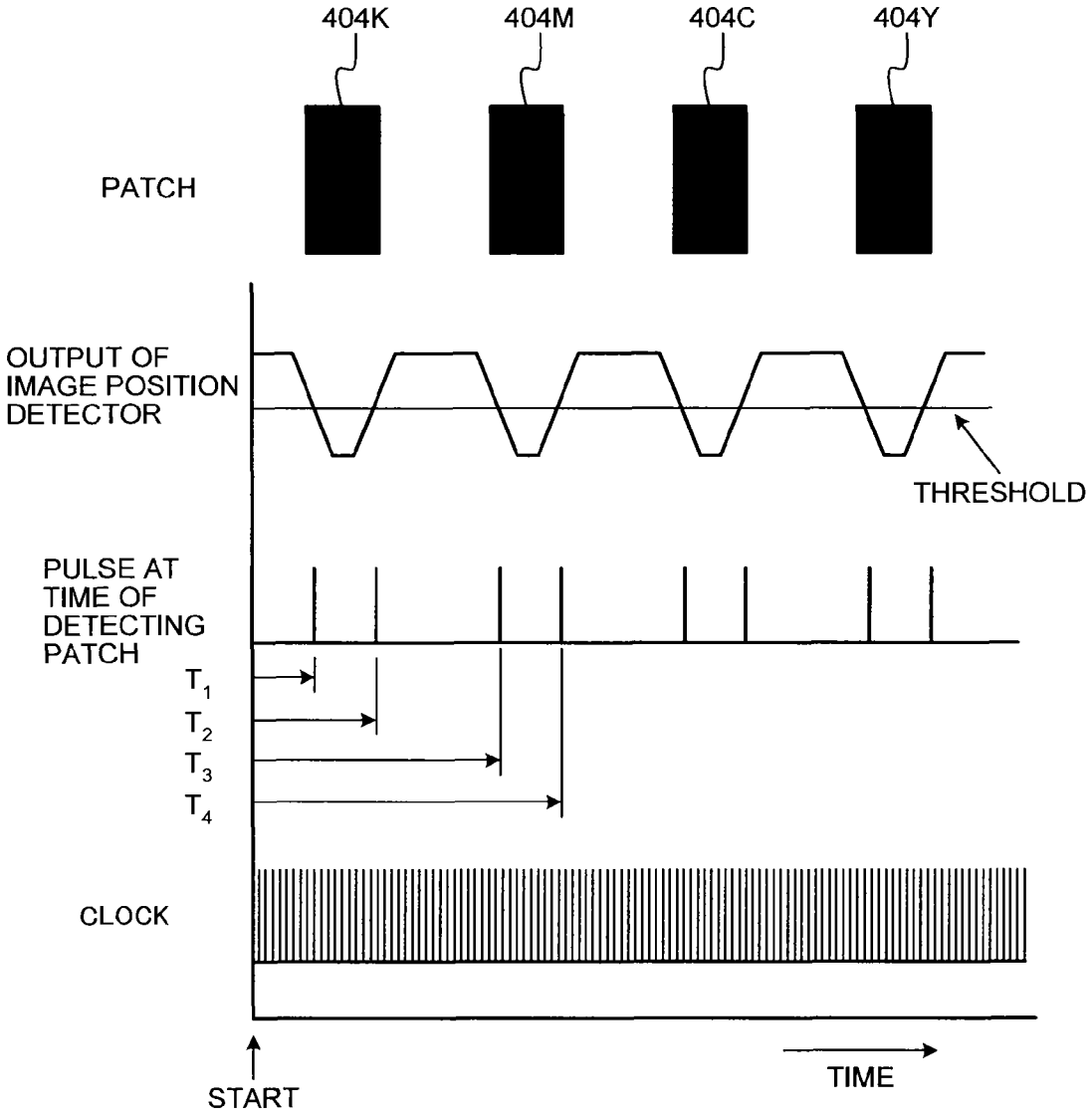
FIG. 7 is a time chart for detecting patches by the image position detector to measure time.

Each of the image position detectors 400*a* to 400*c* includes a light-emitting element and a light-receiving element. Light emitted by the light-emitting element is specular reflected by the intermediate transfer belt 101 and received by the light-receiving element. When a toner patch is present, the amount of light received by the light-receiving element changes and detection signals corresponding to the patches are obtained as illustrated in FIG. 7 as output of the image position detector 400. The detection signals and a threshold value level are compared with each other and a pulse output waveform at the time of the patch detection is output in the form as illustrated in FIG. 7. The number of clocks from start (START) to a pulse at the time of the patch detection is counted, and measurement results $T_1$, $T_2$, . . . , which are converted to time from the counted number of clocks, are obtained. From the measurement results, for example, a value indicating the center position at the time of the patch detection is obtained as follows: $TK=(T_1+T_2)/2$ for the patch 404K; and $TM=(T_3+T_4)/2$ for the patch 404M. The same calculation is performed for the patch 404C and the subsequent patches. Thereafter, a patch interval between the patches 404K and 404M illustrated in FIG. 6 is calculated such that Pm=(TM−TK). The same calculation is performed to obtain intervals Pc, Py, Pmn, Pcn, and Pyn.

Toner Image Pattern Formation Position

It is desirable to adjust a positional relation of the image position detector 400 and light emission patterns to an optimal relation for at least one time, before the patch forming units form the patches for the first time in the above-described manner. A case of diffused light will be explained below.

It is preferable to detect a light emission pattern of the light-emitting element 401 of the image position detector 400 in advance and shift the patch formation position in the main-scanning direction to a position where a variation in the amount of light of the light emission pattern becomes small. This is explained below with reference to FIG. 8 and FIG. 9.

Figure 8:
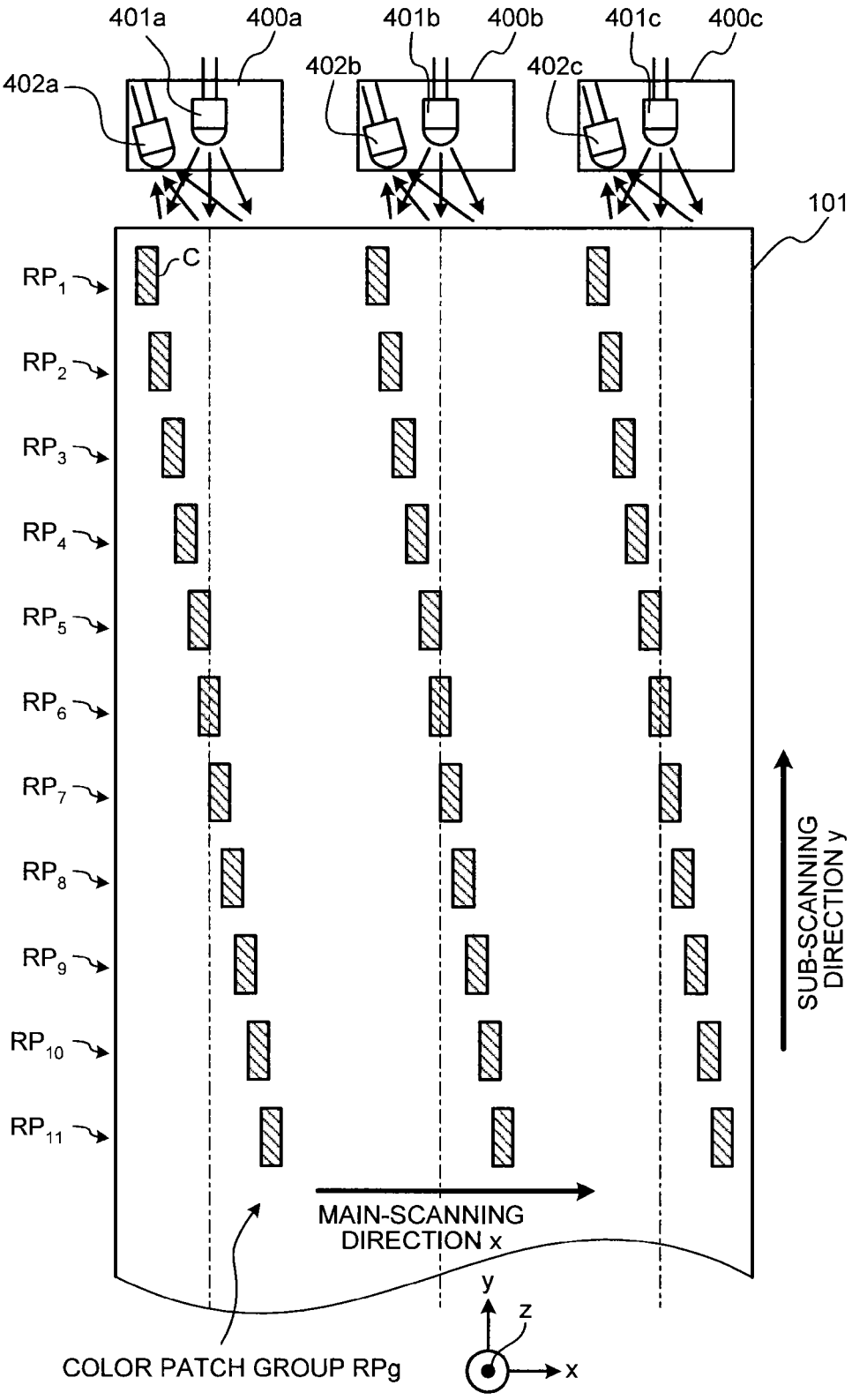
FIG. 8 is a plan view of distributed patches as toner image patterns formed on the intermediate transfer belt.

FIG. 8 is a plan view of distributed toner image patterns $RP_n$ ($RP_1$ to $RP_{11}$) for determining patch formation positions, which are formed on the intermediate transfer belt 101.

The patch forming unit forms a color patch group RPg by sequentially forming a plurality of color patches C (eleven patches $RP_1$ to $RP_{11}$ in FIG. 8) that are formed as lines with predetermined widths and predetermined lengths by using color toner such that the color patches C are shifted by a predetermined shift amount (in the main-scanning direction) and arranged at intervals (in the sub-scanning direction). The image position detector 400 acquires diffused light from the color patches C in chronological order.

Figure 9:
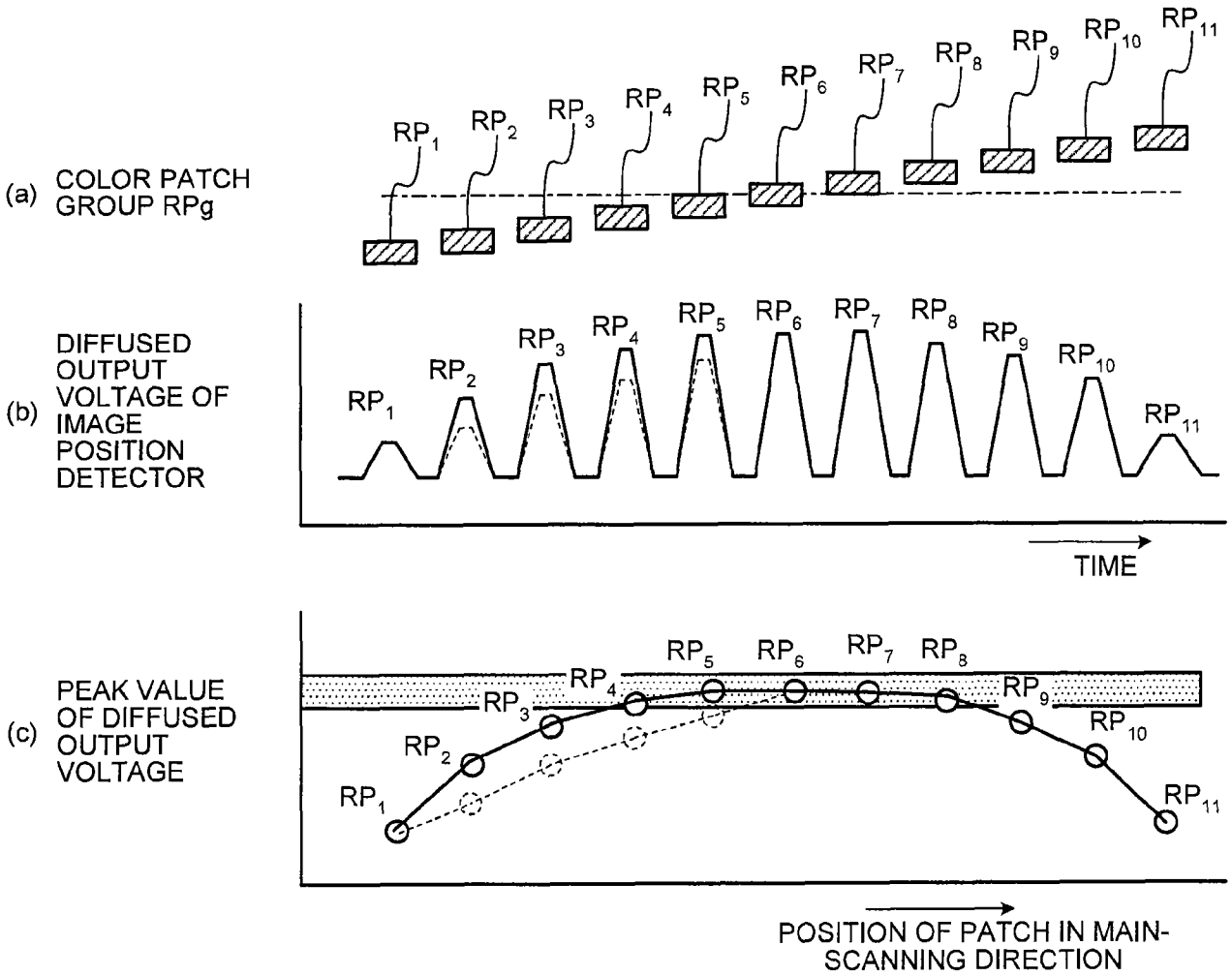
FIG. 9 illustrates a schematic diagram of a color patch group in (*a*), a graph of a waveform of diffused output voltages obtained when the image position detector detects patches in the color patch group in (*b*), and a graph in which peak values of the diffused output voltages are plotted in (*c*)

FIG. 9 illustrates a waveform result of the diffused output voltages acquired by the image position detector 400. Illustrated in (*a*) of FIG. 9 is a schematic diagram of the color patch group RPg which is arranged horizontally in order to clarify correspondence to (*b*) and (*c*) of FIG. 9. Illustrated in (*b*) of FIG. 9 is a graph of a waveform of the diffused output voltages (the vertical axis) obtained when the patches $RP_n$ in the color patch group RPg are detected by the image position detector 400. The horizontal axis of the graph in (*b*) of FIG. 9 represents time. Illustrated in (*c*) of FIG. 9 is a graph in which peak values of the diffused output voltages illustrated in (*b*) of FIG. 9 are plotted. The horizontal axis of the graph in (*c*) of FIG. 9 represents the patch position in the main-scanning direction.

It can be seen from FIG. 9 that the diffused output voltage from the image position detector 400 increases as the amount of light received by the color patches C increases. Therefore, it is possible to obtain the distribution of the light amount at each of the positions of the color patches C. Namely, the light emission pattern on the intermediate transfer belt 101 can be obtained.

When the light emission pattern indicated by bold lines in (*b*) and (*c*) of FIG. 9 is obtained, because the pattern is horizontally symmetric, it is possible to form the toner image pattern $P_n$ described above at the position at which a variation in the light amount is small, by forming the toner image pattern $P_n$ such that the position of the patch $RP_6$ in the main-scanning direction is located in the center. Consequently, it is possible to prevent a detection error. That is, it is desirable to determine write timing of the toner image pattern $P_n$ such that the center of the toner image pattern $P_n$ in the main-scanning direction is located at the position of the patch $RP_6$.

To accurately obtain the position of the patch $RP_6$, for example, points ($RP_4$, $RP_5$, $RP_6$, $RP_7$, and $RP_8$) at which the peak values of the voltages remain in a predetermined determination range (a hatched portion in (*c*) of FIG. 9) are extracted and the center ($RP_6$) of the extracted points is calculated.

By contrast, the light emission pattern indicated by dashed lines in (*b*) and (*c*) of FIG. 9 shows a decrease in the amount of light at left portions and is horizontally asymmetry. However, even in this case, similarly to the above, points ($RP_6$, $RP_7$, and $RP_8$) at which the peak values of the voltages remain in the predetermined determination range are extracted, the center ($RP_7$) of the extracted points is calculated, and write timing of the toner image pattern $P_n$ is determined such that the center of the toner image pattern $P_n$ in the main-scanning direction is located at the position of the point $RP_7$. Consequently, it is possible to suppress occurrence of a detection error.

The determination range illustrated in (*c*) of FIG. 9 needs to be a range of the light intensity that can cover the area in which the toner image patterns $P_n$ are formed. When the area cannot be covered, the determination range is widened and the formation position is calculated again.

After the write timing of the pattern formation position is determined, toner image patterns containing the reference color patches and the color patches are formed, and positional deviation of the color patches with respect to the reference color patches is calculated. In this case, the pattern illustrated in FIG. 5, rather than the pattern illustrated in FIG. 4, is formed at the position at which the diffused light distribution is uniform. Therefore, it is apparent that the same advantages as those of the pattern illustrated in FIG. 4 can be obtained.

A case in which the optimal position is calculated by using specular reflected light will be explained below.

It is preferable to detect a light-applied position of light on the intermediate transfer belt 101 from the light-emitting element 401 of the image position detector 400 in advance and shift the center of a formation position for black K, i.e., for the reference color patch, to a position of the detected light-applied position in the main-scanning direction. This is explained below with reference to FIG. 10 and FIG. 11.

Figure 10:
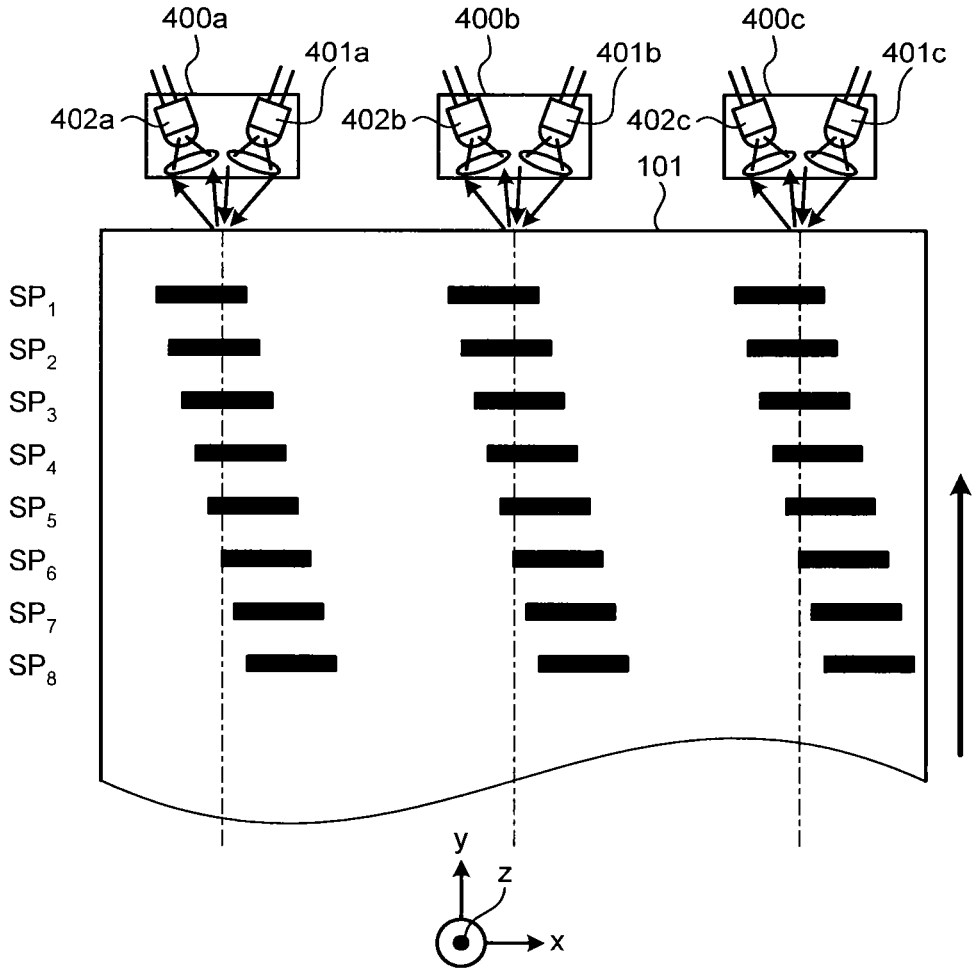
FIG. 10 is a plan view of distributed patches as toner image patterns formed on the intermediate transfer belt for detecting specular reflected light.

FIG. 10 is a plan view of distributed toner image patterns $SP_n$ ($SP_1$ to $SP_8$) formed on the intermediate transfer belt 101 for detecting patch formation positions.

The patch forming unit forms a patch group SPg by sequentially forming a plurality of patches (eight patches $SP_1$ to $SP_8$ in FIG. 10) that are formed as lines with predetermined widths and predetermined lengths by using toner of black K such that the patches are shifted by a predetermined amount (in the main-scanning direction) and arranged at intervals (in the sub-scanning direction). The image position detector 400 acquires specular reflected light from the patches in chronological order.

Figure 11:
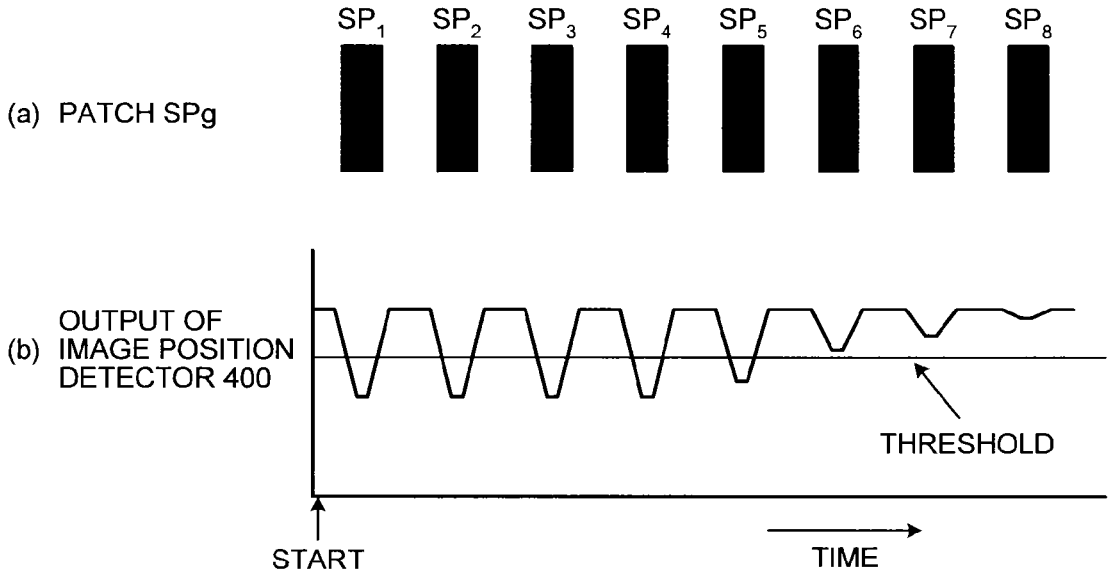
FIG. 11 illustrates a schematic diagram of a patch group in (*a*) and a graph of a waveform of specular-reflection output voltages obtained when the image position detector detects patches in the patch group in (*b*)

FIG. 11 illustrates a waveform result of specular-reflection output voltages acquired by the image position detector 400. Illustrated in (*a*) of FIG. 11 is a schematic diagram of the patch group SPg which is arranged horizontally in order to clarify correspondence to (*b*) of FIG. 11. Illustrated in (*b*) of FIG. 11 is a graph of a waveform of the specular-reflection output voltages (the vertical axis) obtained when the image position detector 400 detects the patches SPn in the patch group $SP_n$. The horizontal axis of the graph in (*b*) of FIG. 11 represents time.

As illustrated in FIG. 11, the specular-reflection output voltage from the image position detector 400 decreases as the amount of specular reflected light from the black K patch on the belt decreases. Therefore, if the light from the light-emitting element 401 crosses the black K patches while the positions of the black K patches are shifted, the distribution of the amount of light changes. That is, it is possible to obtain the light emission position on the intermediate transfer belt 101.

In the case of the light emission pattern indicated by a bold line in (*b*) of FIG. 11, a main-scanning position (the position in the main-scanning direction) of the patch SP6 having a value greater than a threshold is determined as the center position for detection performed by the image position detector 400. The patch 404 (404K to 404Y and 404KN to 404YN) illustrated in FIG. 6 are formed such that the center position determined as above matches the center position of the patch 404 in the main-scanning direction. Therefore, it is possible to from a toner image pattern (a patch) at the position where a variation in the amount of light is small. Consequently, it is possible to prevent occurrence of a detection error, minimize the patch widths, and minimize the toner consumption for the patches. In the example illustrated in FIG. 11, it is desirable to determine write timing of the patches 404K to 404Y and 404KN to 404YN such that the centers of the patches 404K to 404Y and 404KN to 404YN are located at the position of the patch $SP_6$.

To accurately obtain the position of the patch $SP_6$, it is preferable to reduce the shift amount in the main-scanning direction and increase the number of patches.

In this way, the patch forming unit determines the formation positions of the toner image patterns $RP_n$ and $SP_n$ as described above. Therefore, it is possible to form a pattern at the position where a variation in the amount of light is small, enabling to minimize a detection error and obtain a reliable result through a positional deviation calculation. The toner image pattern to be formed is not limited to the toner image pattern illustrated in FIG. 3 but may be any pattern. It is possible to form a pattern at the position where a variation in the amount of light is small without using the toner image pattern illustrated in FIG. 3. Therefore, it is possible to minimize a detection error and obtain a printed image of good quality with less color deviation or color-shade variation.

Detection on Secondary Transfer Belt

Figure 12:
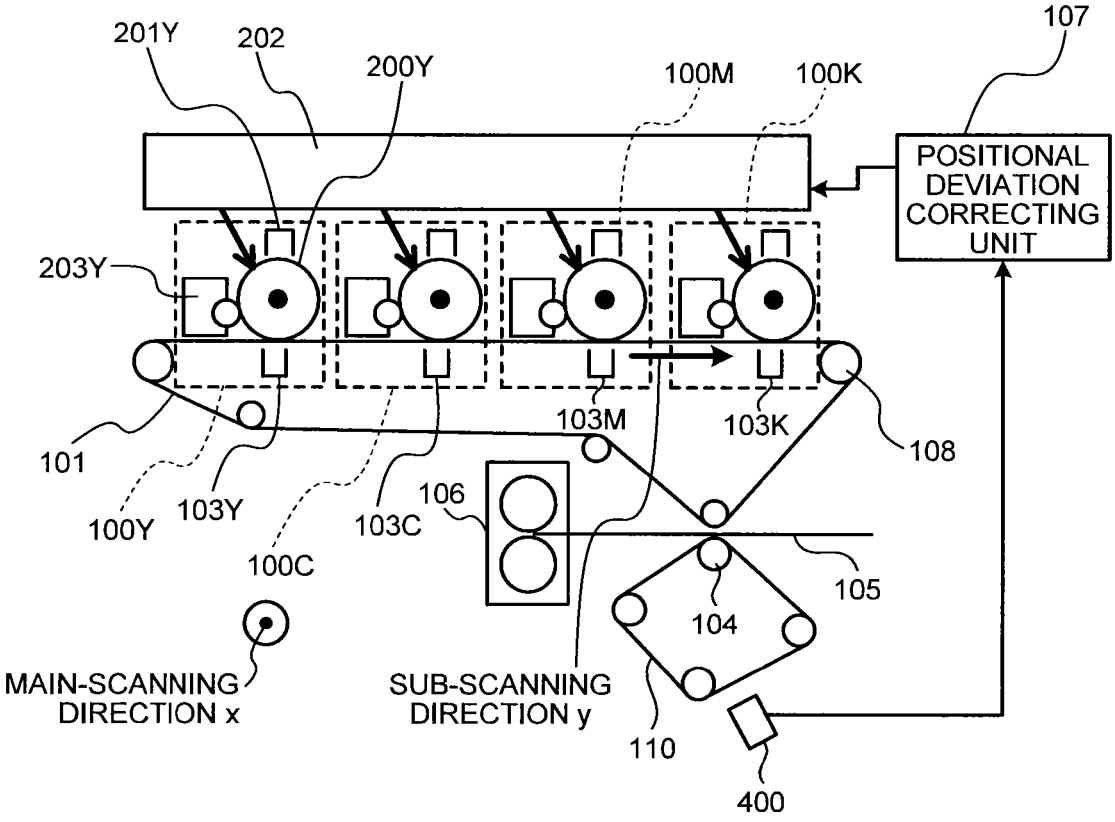
FIG. 12 is a schematic configuration diagram of an image forming apparatus including a secondary transfer belt according to an embodiment.

An example in which a toner image pattern is detected on a secondary transfer belt will be explained with reference to FIG. 12. In the configuration illustrated in FIG. 1, a toner image is transferred onto the sheet 105 by using the secondary transfer charger 104 (a secondary transfer roller). In the configuration illustrated in FIG. 12, to increase available recording sheets, an elastic (rubber) belt is used as the intermediate transfer belt 101 and a polyimide (PI) belt is used as a secondary transfer belt 110.

When the elastic belt is used as the intermediate transfer belt 101, because the surface of the elastic belt is rougher than that of the PI belt (the secondary transfer belt 110), the amount of diffused light among the reflected light increases. Therefore, it becomes difficult for the image position detector 400 to detect the toner image pattern on the intermediate transfer belt 101. Therefore, in the configuration illustrated in FIG. 12, the image position detector 400 detects the toner image pattern on the secondary transfer belt 110. For this, the image position detector 400 is disposed at a certain position on the secondary transfer belt 110. The toner image pattern is the same as described in the above embodiment. The toner image pattern formed on the intermediate transfer belt 101 is transferred onto the secondary transfer belt 110 by the secondary transfer charger 104. The image position detector 400 detects the toner image pattern transferred on the secondary transfer belt 110. Accordingly, the amount of deviation of a recording position and a position adjustment value are calculated. While not illustrated in FIG. 12, the toner image pattern detected on the secondary transfer belt 110 is removed by a cleaner.

According to the image forming apparatus of the embodiment described above, a patch is formed such that positional deviation due to a detection error of the detecting unit caused by a non-uniform light emission pattern of the detecting unit can be prevented in order to reduce a read error that may occur at the time of reading the patch, and thereafter, a correction amount is calculated based on the patch. Therefore, it is possible to obtain a printed image of good quality with less color deviation or color-shade variation.

The above embodiment is a preferred embodiment of the present invention; however, the present invention is not limited to this embodiment. The present invention may be modified or embodied in various forms within the scope of the technical idea of the present invention. For example, the above embodiment is explained with an example in which the image forming apparatus using a Carlson process of a tandem system is used; however, the present invention is not limited to this example. For example, the present invention can be applied to image forming apparatuses of other printing systems, such as laser printers or inkjet printers.

Image Forming Apparatus of Inkjet System

Figure 13:
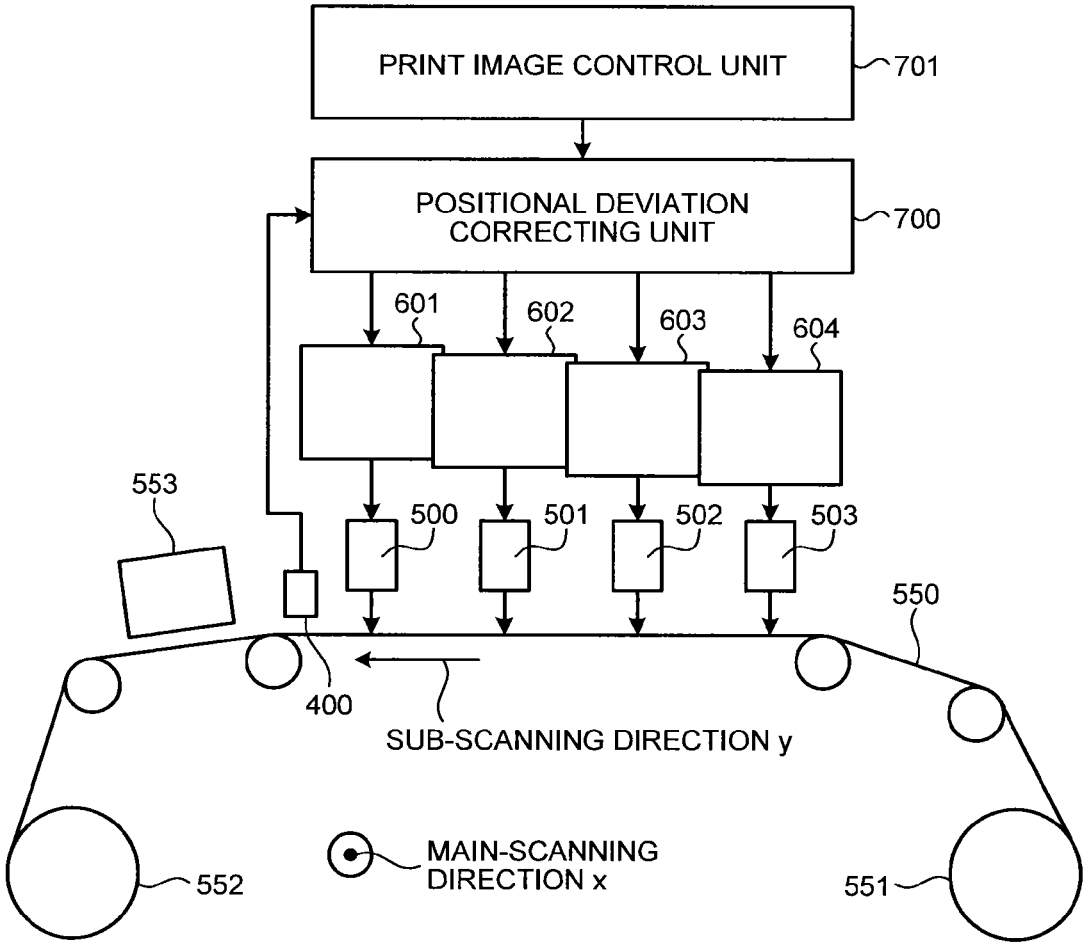
FIG. 13 is a schematic configuration diagram of an image forming apparatus of an inkjet system according to an embodiment.

An embodiment will be explained below in which an image forming apparatus of an inkjet system is used. FIG. 13 is a schematic configuration diagram of a color image forming apparatus of an inkjet system according to an embodiment.

In the configuration in FIG. 13, an inkjet recording mechanism of a tandem system including inkjet heads 500, 501, 502, and 503 arranged in the sub-scanning direction corresponds to an image forming means (an image forming unit). The inkjet heads 500, 501, 502, and 503 eject ink of colors of black K, cyan C, magenta M, and yellow Y, respectively, and perform linear recording in the main-scanning direction.

In this example, a sheet 550 is not a cut sheet but a continuous sheet, such as a roll sheet. The roll sheet is a sheet wound around a roll. As illustrated in FIG. 13, the roll sheet is set to a roll 551 at the beginning. The roll sheet passes by the inkjet heads 500 to 503 and a drier 553 that dries ink, and wound around a roll 552 at the end. In the subsequent process, only a needed portion of the continuous sheet in a print area is cut and used at the end.

In the configuration in FIG. 13, a belt is not provided. Therefore, the image forming means (the inkjet heads 500 to 503) forms a toner image pattern as described above on at least one of the outside of an effective print area of the roll sheet in the sub-scanning direction or on the outside of an effective print area of the roll sheet in the main-scanning direction. The effective print area is a range in which print data received from an upper device is printable. The toner image pattern printed on the outside of the effective print area is removed in the subsequent process (for example, a sheet cutting process).

The image position detector 400 is the same as described in the above embodiment (for example, FIG. 1) and detects the toner image pattern. A positional deviation correcting unit 700 calculates the amounts of deviation of the recording positions and position adjustment values for the colors of magenta M, cyan C, and yellow Y with respect to the recording position of black K. The positional deviation correcting unit 700 corresponds to the positional deviation correcting unit 107 described above. Upon reception of a print command, the positional deviation correcting unit 700 adjusts the image formation positions of the inkjet heads 500 to 503 in the main-scanning direction or adjusts recording dot sizes by using the adjustment values corresponding to the image formation positions of the inkjet heads 500 to 503 in the main-/sub-scanning directions at a recording step of forming an image so that positional deviation can hardly occur. The adjustment value corresponding to each of the image formation positions are determined by, for example, referring to a relevance table in which the image formation position and the adjustment value are associated with each other. The adjustment value includes, for example, a delay time, an advanced time, or a timing of an image signal used for removing the positional deviation.

In the color image forming apparatus of the inkjet system, the positional deviation correcting unit 700, ejection driving circuits 601 to 604, and a print image control unit 701 correspond to a means (a positional difference adjusting unit) for adjusting relative positional deviation of images of different colors. The ejection driving circuits 601 to 604 eject and bias ink by driving the inkjet heads 500 to 503, respectively.

The print image control unit 701 gives, to the ejection driving circuits 601 to 604, image signals to be sent to the inkjet heads 500 to 503. The print image control unit 701 adds, to the image signals to be given to the ejection driving circuits 601 to 604, a delay time or an advanced time in the sub-scanning direction in accordance with the adjustment values contained in the relevance table. The print image control unit 701 gives, to the ejection driving circuits 601 to 604, data for designating a driving voltage of ejection nozzles so that the positions at which the inkjet heads 500 to 503 eject ink from nozzles can be adjusted and positional deviation in the main-scanning direction can be made invisible.

According to the embodiments, it is possible to obtain a printed image of good quality with less color deviation and color shade variation.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a patch forming unit configured to form a patch group containing a plurality of patch subgroups arranged in a sub-scanning direction, each of the patch subgroups containing a reference color patch formed with toner of a reference color and a color patch formed with toner of a different color such that the reference color patch and the color patch are arranged in a main-scanning direction, wherein the reference color patches are shifted from each other in the main-scanning direction, the color patches are shifted from each other in the main-scanning direction, and the patch subgroups include reference patch subgroups in each of which the reference color patch covers over the color patch and detection patch subgroups in each of which at least part of the color patch does not overlap with the reference color patch; and a positional deviation correcting unit configured to calculate a correction amount based on a detection result of the reference patch subgroups and the detection patch subgroups detected by a detecting unit, wherein the patch forming unit forms the detection patch subgroups so that each of the parts of the color patches in the detection patch subgroups has a non-overlapping portion with a different width in the main-scanning direction and center positions of the different widths of the non-overlapping portions of the color patches in the patch group are substantially aligned in the sub-scanning direction.

2. The image forming apparatus according to claim 1, wherein the patch forming unit forms the reference patch subgroups on both sides across the center positions in the main-scanning direction.

3. The image forming apparatus according to claim 1, wherein the patch group includes a plurality of lines in each of which the reference patch subgroups and the detection patch subgroups are arranged in sequence in the sub-scanning direction, and the patch forming unit forms, for each of the lines, the detection patch subgroups so that center positions of non-overlapping portions of the color patches that do not overlap with the reference color patches in the main-scanning direction are located at substantially a same position in the patch group.

4. The image forming apparatus according to claim 1, wherein the patch forming unit forms a plurality of patch groups in the main-scanning direction.

5. The image forming apparatus according to claim 1, wherein the patch forming unit forms the patch group on an intermediate transfer unit, and the intermediate transfer unit is in the reference color.

6. The image forming apparatus according to claim 1, wherein the patch forming unit forms the patch group on a secondary transfer unit.

7. The image forming apparatus according to claim 1, wherein the reference color is black.

8. The image forming apparatus according to claim 1, wherein the detecting unit is a reflective photosensor including a light-emitting element and a light-receiving element.

9. The image forming apparatus according to claim 8, a spot diameter of light applied onto the intermediate transfer unit by the light-emitting element is equal to or greater than a width of each of the patch subgroups in the main-scanning direction.

10. The image forming apparatus according to claim 1, wherein the detecting unit is disposed at a position that enables the detecting unit to detect the patch subgroups on an intermediate transfer unit or a secondary transfer unit.

11. The image forming apparatus according to claim 1, wherein the patch forming unit forms the patch group on an outside of a print area.

12. The image forming apparatus according to claim 1, wherein the positional deviation correcting unit calculates an intersection of two straight lines of outputs on both sides of an inflection point of optical detection values of the patch subgroups contained in the patch group detected by the detecting unit, and calculates the correction amount based on the intersection.

13. An image forming apparatus comprising:

a patch forming unit configured to form a patch group containing patches in sequence in a sub-scanning direction so that the patches are shifted from each other in a main-scanning direction;

a detecting unit configured to detect reflected light from each of the patches contained in the patch group; and a positional deviation correcting unit configured to calculate a correction amount based on the reflected light detected by the detecting unit, wherein the patch forming unit forms the patch group so that a position at which a variation in an amount of the reflected light is small is located in a center of a range of the patches contained in the patch group in the main-scanning direction, the patch forming unit forms the patch group containing color patches formed with toner of a certain color so that the color patches are arranged in sequence in the sub-scanning direction and shifted from each other in the main-scanning direction, the detecting unit detects reflected light from each of the color patches contained in the patch group, and the patch forming unit forms a reference color patch formed with toner of a reference color different from the color patches so that the position at which the variation in the amount of the reflected light is small is located at a center position of the reference color patch in the main-scanning direction.

14. An image forming apparatus comprising:

a patch forming unit configured to form a patch group containing patches in sequence in a sub-scanning direction so that the patches are shifted from each other in a main-scanning direction;

a detecting unit configured to detect reflected light from each of the patches contained in the patch group; and a positional deviation correcting unit configured to calculate a correction amount based on the reflected light detected by the detecting unit, wherein the patch forming unit forms the patch group so that a position at which a variation in an amount of the reflected light is small is located in a center of a range of the patches contained in the patch group in the main-scanning direction, and the patch group formed by the patch forming unit contains a plurality of patch subgroups arranged in a sub-scanning direction, each of the patch subgroups containing a reference color patch formed with toner of a reference color and a color patch formed with toner of a different color such that the reference color patch and the color patch are arranged in a main-scanning direction, wherein the reference color patches are shifted from each other in the main-scanning direction, the color patches are shifted from each other in the main-scanning direction, and the patch subgroups include reference patch subgroups in each of which the reference color patch covers over the color patch and detection patch subgroups in each of which at least part of the color patch does not overlap with the reference color patch.

15. The image forming apparatus according to claim 14, wherein the detecting unit detects the position at which the variation in the amount of reflected light is small by comparing the amount of the reflected light with a threshold value, and the patch forming unit forms the reference color patch so that the detected position is located in a center of the reference color patch in the main-scanning direction.

* * * * *